United States Patent [19]

Clare

[11] 4,315,572

[45] Feb. 16, 1982

[54] PERIODICAL SUPPORT AND RETRIEVAL DEVICE

[76] Inventor: David H. Clare, Box 50, Rte. 1, Eau Galle, Wis. 54737

[21] Appl. No.: 144,550

[22] Filed: Apr. 28, 1980

[51] Int. Cl.[3] ..... A47F 7/16

[52] U.S. Cl. ..... 211/45; 211/123; 211/105.1; 211/193

[58] Field of Search ..... 211/45, 123, 105.1, 211/193, 181

[56] References Cited

U.S. PATENT DOCUMENTS

| | | | |
|---|---|---|---|
| 3,442,396 | 5/1969 | Cass | 211/105.1 |
| 3,693,808 | 9/1972 | Rauch | 211/181 |
| 3,789,996 | 2/1974 | Stroh | 211/181 |
| 3,860,119 | 1/1975 | Irvine | 211/45 |
| 3,983,822 | 10/1976 | Suttles | 211/193 |
| 3,990,582 | 11/1976 | Schindel | 211/105.1 |

*Primary Examiner*—Reinaldo P. Machado
*Attorney, Agent, or Firm*—Williamson, Bains, Moore & Hansen

[57] ABSTRACT

A support and retrieval device for magazines, newspapers and the like, includes a U-shaped base having a pair of vertical legs projecting upwardly therefrom. An elongate, slotted, support member extends between and is secured to the upper ends of the vertical legs of the base. A plurality of elongate support bars frictionally engage the slots of the support member and project therefrom. Periodicals, such as magazines, newspapers or the like, are supported on the support bars in a manner to permit ready identification of the periodicals and thereby ready retrieval thereof.

3 Claims, 2 Drawing Figures

PERIODICAL SUPPORT AND RETRIEVAL DEVICE

SUMMARY OF THE INVENTION

This invention relates to a device for supporting periodicals to permit ready retrieval thereof.

It is an object of this invention to provide a novel support device for periodicals, such as magazines, newspapers or the like, which is of simple and inexpensive construction, and which permits ready retrieval of the periodicals.

A more specific object of this invention is to provide a novel support and retrieval device for periodicals including a U-shaped base having upstanding legs to which is secured a slotted support member having a plurality of elongate, support elements projecting therefrom supporting periodicals, such as newspapers, magazines or the like.

These and other objects and advantages of this invention will more fully appear from the following description made in connection with the accompanying drawings, wherein like reference characters refer to the same or similar parts throughout the several views.

FIGURES OF THE DRAWINGS

FIG. 1 is a front perspective view of the novel periodical support and retrieval device; and FIG. 2 is a cross-sectional view taken approximately along line 2—2 of FIG. 1 and looking in the direction of the arrows.

DESCRIPTION OF THE PREFERRED EMBODIMENT OF THE INVENTION

Figure 1:
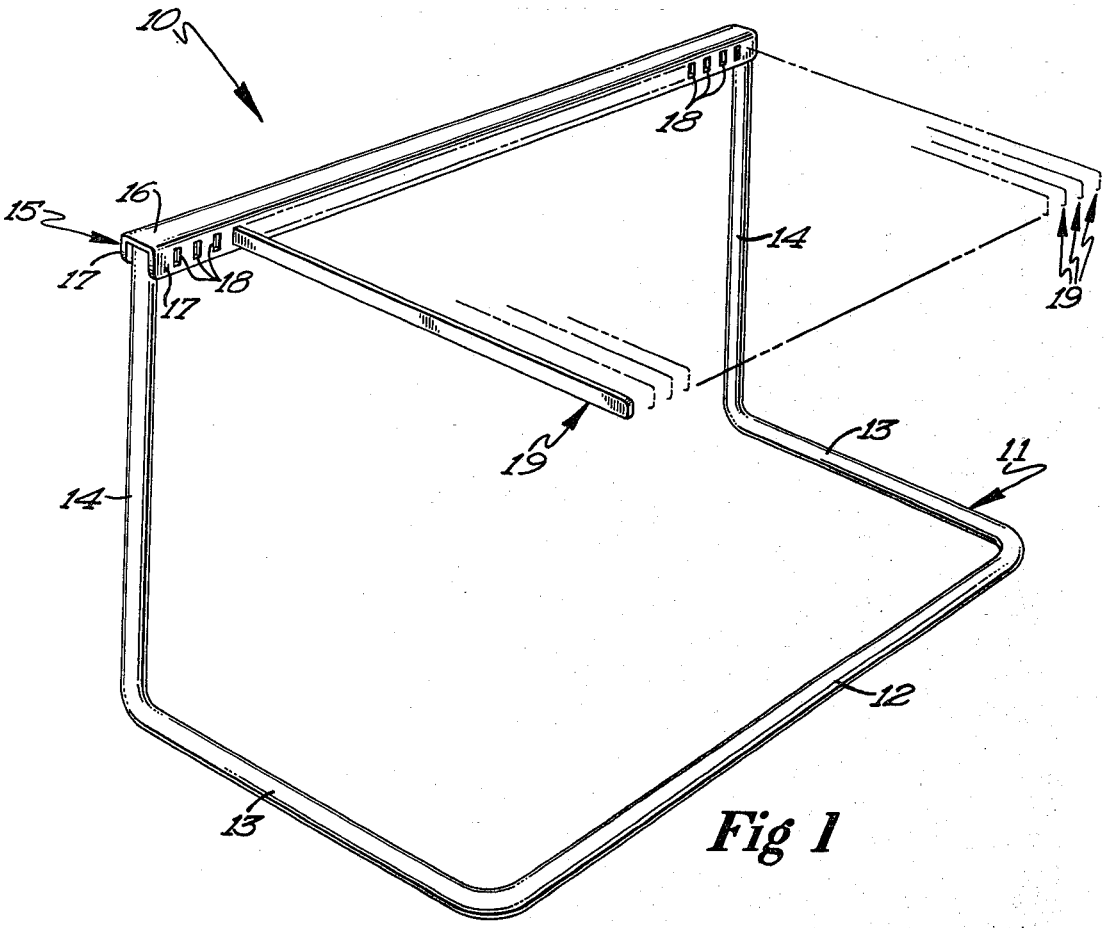

Referring now to the drawings and more particularly to FIG. 1, it will be seen that one embodiment of the novel periodical support and retrieval device, designated generally by the reference numeral, 10 is thereshown. The support and retrieval device 10 is used to support periodicals such as magazines, newspapers and the like in a manner to permit ready identification and retrieval of these periodicals. The device includes a generally U-shaped tubular base 11 including an elongate tubular central element 12 having a pair of elongate tubular side elements integral therewith and projecting in substantially right angular relation therefrom. It will be noted that the side elements 13 are disposed in substantially parallel relation with respect to each other and each has one end thereof integral with one of the pairs of elongate vertical legs 14. It will also be noted that the legs 14 are also of tubular construction and are disposed in substantially parallel relation with respect to each other.

An elongate substantially straight support member 15 extends between and is rigidly affixed to the upper ends of the vertical legs 14. It will be seen that the support member 15 is of U-shaped cross-sectional configuration and includes a web 16 having a pair of flanges integral therewith and extending downwardly therefrom. The flanges 17 are provided with slots 18 therein, a slot 18 in one flange being disposed in registering or aligned relation with a slot 18 in the other flange. It will be noted that the slots 18 are longitudinally spaced apart and extend throughout the length of the support member 15.

Figure 2:
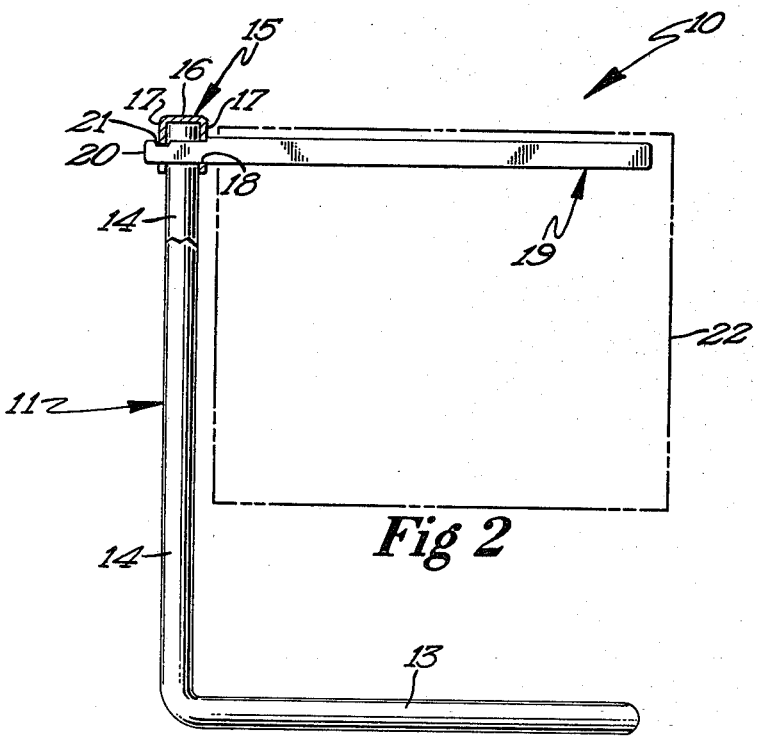

A plurality of similar elongate substantially flat support bars or elements 19 are provided each having a reduced rear end portion 20, the latter having an upwardly facing notch 21 in the upper edge thereof, as best seen in FIG. 2. The reduced end portion of each bar 19 is urged through a pair of aligned slots 18 so that the notch 21 engages a peripheral edge defining the associated slot in the rear flange 17. With this arrangement, the bars 19 are supported in cantilever fashion and project outwardly from the support member 15. It will be noted that the bars 19 having a length dimension corresponding generally to the length dimension of the side elements 13 and are disposed in substantially parallel relation therewith.

The support and retrieval device 10 is adapted to support periodicals 22, such as magazines, newspapers and the like from the support elements 19 as shown in FIG. 2. With this arrangement, a plurality of periodicals can be readily suspended from a support and retrieval device so that the cover or title page of the periodical will be plainly visible to a person interested in a particular publication. In this regard, the periodicals can be arranged chronologically from one end of the support member and associated bars to the other end thereof. This type of placement of the periodicals permits easy retrieval by the person. It will therefore be seen that my novel support and retrieval device is especially ideal for repositories of periodicals such as libraries and the like. The researcher may merely locate the particular support device and very quickly and easily retrieve a particular issue of a publication.

Thus, it will be seen that I have provided a novel support and retrieval device which is not only of simple and inexpensive construction but one which functions in a more efficient manner that any heretofore known comparable device.

It is anticipated that various changes can be made in the size, shape and construction of the support and retrieval device disclosed herein without departing from the spirit and scope of my invention as defined in the following claims.

What is claimed is:

1. A support and retrieval device for periodicals, such as magazines, newspapers and the like, comprising:

a U-shaped base including an elongate, central element having a pair of substantially elongage side elements integral therewith and projecting therefrom, a pair of elongate, substantially straight vertical support elements each having one end thereof integral therewith with one of said side elements and projecting upwardly therefrom, an elongate substantially straight support member having opposite ends thereof secured to the upper ends of said vertical elements, said support member having a plurality of longitudinally spaced apart vertically extending slots therein throughout the length thereof, a plurality of elongate, substantially flat identical support elements each having one end thereof frictionally engaged in one of said slots in the support member and projecting therefrom, said support elements adapted to support periodicals such as magazines or newspapers therefrom and thereby permitting ready retrieval of such periodicals.

2. A support and retrieval device as defined in claim 1 wherein said elongate support member is of U-shaped configuration including a web having a pair of flanges integral therewith and depending therefrom, each of said flanges having a plurality of said vertically extending longitudinally spaced slots therein, a slot in one of said flanges being disposed in registering relation with the slot in the other of said flanges, each of said support elements projecting through a pair of registering slots in said support member.

3. The device as defined in claim 2 wherein each of said elongate support elements has a reduced rear end portion which projects through a pair of registering slots in said flanges, and a notch in said reduced end portion of each of said support elements engaging one of said flanges to releasably lock each of said bars in attached relation with respect to said support member.

* * * * *